US009845794B2

(12) United States Patent
Seith et al.

(10) Patent No.: US 9,845,794 B2
(45) Date of Patent: Dec. 19, 2017

(54) HYDRAULICALLY ACTUATED DIAPHRAGM PUMPS

(71) Applicant: Ingersoll-Rand Company, Davidson, NC (US)

(72) Inventors: Warren A. Seith, Bethlehem, PA (US); Aaron M. Crescenti, Glen Gardner, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 233 days.

(21) Appl. No.: 14/049,088

(22) Filed: Oct. 8, 2013

(65) Prior Publication Data

US 2015/0098837 A1 Apr. 9, 2015

(51) Int. Cl.
*F04B 9/04* (2006.01)
*F04B 43/02* (2006.01)
(Continued)

(52) U.S. Cl.
CPC ..... *F04B 9/045* (2013.01); *F04B 43/026* (2013.01); *F04B 43/067* (2013.01);
(Continued)

(58) Field of Classification Search
CPC ..... F04B 43/02; F04B 43/023; F04B 43/028; F04B 45/041; F04B 45/043; F04B 45/045;
(Continued)

(56) References Cited

U.S. PATENT DOCUMENTS 2,752,854 A 7/1956 Prior et al.
2,808,005 A 10/1957 Fannin
(Continued)

FOREIGN PATENT DOCUMENTS

DE 200 08188 U1 10/2000
DE 200 08 188 U1 11/2000
(Continued)

OTHER PUBLICATIONS

Author: Rockwell Automation Title: Basisc for practical operation motor protection Date Published (yyyy): 1997 Date Accessed (mm/dd/yyyy): Jul. 28, 2015 Link: https://www.rockwellautomation.com/resources/downloads/rockwellautomation/che/pdf/Basics_practical_operationMotor_protection.pdf.*
(Continued)

*Primary Examiner* — Theodore Stigell
*Assistant Examiner* — Chirag Jariwala
(74) *Attorney, Agent, or Firm* — Barnes & Thornburg LLP

(57) ABSTRACT

A diaphragm pump may comprise a housing defining a first pumping chamber, a second pumping chamber, and a hydraulic fluid chamber, a first flexible diaphragm separating the first pumping chamber from the hydraulic fluid chamber, a second flexible diaphragm separating the second pumping chamber from the hydraulic fluid chamber, a rod mechanically linking the first flexible diaphragm and the second flexible diaphragm such that an expansion of one of the first and second flexible diaphragms exerts a contraction force on the other of the first and second flexible diaphragms, and a piston disposed within the hydraulic fluid chamber and configured to reciprocate to cause a hydraulic fluid contained within the hydraulic fluid chamber to alternately exert an expansion force on the first and second flexible diaphragms.

14 Claims, 5 Drawing Sheets

(51) Int. Cl.
*F04B 43/067* (2006.01)
*F04B 49/06* (2006.01)

(52) U.S. Cl.
CPC .... *F04B 49/065* (2013.01); *F04B 2201/0206* (2013.01); *F04B 2201/1202* (2013.01); *F04B 2203/0201* (2013.01)

(58) Field of Classification Search
CPC .... F04B 45/047; F04B 43/025; F04B 43/026; F04B 43/06; F04B 43/0736; F04B 45/053; F04B 45/036; F04B 9/045; F04B 43/067; F04B 49/065; F04B 2201/0206; F04B 2201/1202; F04B 2203/0201
USPC ..... 417/63, 415, 534–536, 413.1, 393, 395, 417/397, 386; 92/96, 100, 138
See application file for complete search history.

(56) References Cited

U.S. PATENT DOCUMENTS

| | | | | |
|---|---|---|---|---|
| 3,148,624 | A | 9/1964 | Baldwin | |
| 3,192,860 | A | 7/1965 | Hardison | |
| 3,643,770 | A * | 2/1972 | Faulds | 192/56.5 |
| 3,816,029 | A | 6/1974 | Bowen et al. | |
| 4,705,461 | A * | 11/1987 | Clements | B29B 7/603 417/387 |
| 4,856,966 | A * | 8/1989 | Ozawa | 417/214 |
| 4,966,528 | A * | 10/1990 | Henkel et al. | 417/63 |
| 5,616,005 | A * | 4/1997 | Whitehead | F01L 25/066 417/342 |
| 5,649,809 | A * | 7/1997 | Stapelfeldt | 417/63 |
| 5,860,793 | A | 1/1999 | Muscarella et al. | |
| 5,976,184 | A | 11/1999 | Buecherl et al. | |
| 6,561,774 | B2 | 5/2003 | Layman | |
| 8,196,667 | B2 | 6/2012 | Ocalan et al. | |
| 8,360,750 | B2 | 1/2013 | Ferk et al. | |
| 8,529,223 | B2 * | 9/2013 | Cohoon | E03D 5/01 4/332 |
| 2005/0042111 | A1 * | 2/2005 | Zaiser | F04B 9/02 417/225 |
| 2006/0269427 | A1 * | 11/2006 | Drummond, Jr. | F04B 43/02 417/413.1 |
| 2009/0030402 | A1 * | 1/2009 | Adahan | 604/540 |

FOREIGN PATENT DOCUMENTS

| | | | | |
|---|---|---|---|---|
| EP | 1160450 | A2 * | 12/2001 | F04B 43/00 |
| EP | 1 515 044 | A1 | 3/2005 | |
| EP | 1515044 | | 3/2005 | |
| EP | 1515044 | A1 * | 3/2005 | F04B 43/04 |
| WO | 2007/088530 | A1 | 8/2007 | |
| WO | WO-2007/088530 | A1 | 8/2007 | |

OTHER PUBLICATIONS

Auhor: Omron Title: Overview of motor protection relays Date Published(mm/dd/yyyy): Oct. 28, 2012 Date Accessed (mm/dd/yyyy): Jul. 28, 2015 Link:https://web.archive.org/web/20121028041435/http://www.ia.omron.com/support/guide/65/overview.html.*

Author: Stock, Andrew Title: Comparing performance and efficiency of linear motors, ball screws, and rack-and-pinion drives Date Published (mm/dd/yyyy): Feb. 3, 2010 Date accessed (mm/dd/yyyy): Mar. 18, 2016 Link: http://machinedesign.com/archive/comparing-performance-and-efficiency-linear-motors-ball-screws-and-rack-and-pinion-drives.*

Williams Milton Roy, "WILROY Hydraulically Actuated Diaphragm Pump," available at http://www.williamspumps.com/Files/Williams_Pumps/Global/US-en/pdfsanddocs/WILROY7_16.pdf, 2006, 6 pages.

Pulsafeeder, "PULSA Series Hydraulic Diaphragm Metering Pump," available at http://www.pulsafeeder.com/downloads/pdf/pulsa-series-brochure-en.pdf, 2011, 8 pages.

Lewa GMBH, "Pump Head Technology," available at http://www.lewa.com/en/competence/technologies/pump-head-technology/, 2013, 2 pages.

Minimax Pumps, "Hydraulic Actuated Diaphragm Pumps," available at http://www.minimaxdosing.com/hydraulic_actuated_diaphragm_pumps.html, 2013, 5 pages.

McFarland-Tritan, LLC, "Diaphragm Pumps," available at http://www.mcfarlandpump.com/macj5.htm, 2013, 2 pages.

Lutz-Jesco America Corp., "Metering Pumps—1700 Series," available at http://www.jescoamerica.com/product_detail.asp?id=38, 2013, 1 page.

Cole-Parmer, "Hydraulically Actuated Diaphragm Pump," available at http://www.coleparmer.com/buy/product/8587-hydraulically-actuated-diaphragm-pump-pvc-ptfe-wetted-end-7-0gph.html, 2013, 2 pages.

Dencil Pumps & Systems Pvt. Ltd., "Diaphragm Pumps," available at http://www.dencilpumps.com/diaphragm-pump.htm, 2013, 3 pages.

Dayton Electric Manufacturing Co., "Pumps Factsheet," 2006, 2 pages.

ITT Industries, "Flojet G-57 Series Industrial Air Driven Pump," 2006, 4 pages.

Idez Pump Technologies Ltd., Service & Operating Manual: Air Operated Double Diaphragm Pump, Sep. 17, 2012, 10 pages.

European Patent Office, Communication from European Patent Application No. 14183377.2, dated Mar. 26, 2015, 7 pages.

European Search Report from EP 14183377.2-1608 dated Mar. 26, 2015, 7 pages.

Chinese Patent Application No. 201410499408.9; Second Office Action dated Dec. 28, 2016.

European Office Action; dated Apr. 20, 2017; Application No. 14 183 377.2-1616; Applicant, Ingersoll-Rand Company.

Chinese Office Action; dated Jun. 20, 2017; Application No. 201410499408.8; Applicant, Ingersoll-Rand Company.

* cited by examiner

HYDRAULICALLY ACTUATED DIAPHRAGM PUMPS

TECHNICAL FIELD

The present disclosure relates, generally, to diaphragm pumps and, more particularly, to hydraulically actuated diaphragm pumps.

BACKGROUND

Pneumatic diaphragm pumps have been used for pumping one or more fluids. Pneumatic diaphragm pumps generally include at least one pumping chamber having a diaphragm separating a motive fluid chamber for moving a motive fluid and a pump chamber for pumping a working fluid. Compressed air is fed into the motive fluid chamber to expand the diaphragm, which, in turn, causes the working fluid to be pumped through an outlet of the pump chamber. While pneumatic diaphragm pumps utilizing compressed air are effective, they may also be very inefficient and, thus, very costly.

SUMMARY

According to one aspect, a diaphragm pump may comprise a housing defining a first pumping chamber, a second pumping chamber, and a hydraulic fluid chamber, a first flexible diaphragm separating the first pumping chamber from the hydraulic fluid chamber, a second flexible diaphragm separating the second pumping chamber from the hydraulic fluid chamber, a rod mechanically linking the first flexible diaphragm and the second flexible diaphragm such that an expansion of one of the first and second flexible diaphragms exerts a contraction force on the other of the first and second flexible diaphragms, and a piston disposed within the hydraulic fluid chamber and configured to reciprocate to cause a hydraulic fluid contained within the hydraulic fluid chamber to alternately exert an expansion force on the first and second flexible diaphragms.

In some embodiments, the diaphragm pump may further comprise a motor operatively connected to the piston to cause reciprocal movement of the piston. The motor may comprise a rotatable output shaft, an arm having a first end attached to the output shaft, and a roller bearing attached to a second end of the arm opposite the first end. The piston may comprise a cavity receiving the roller bearing, such that rotation of the output shaft causes movement of the roller bearing within the cavity, thereby causing reciprocal movement of the piston.

In some embodiments, the diaphragm pump may further comprise a mechanism configured to deactivate the motor upon detection of a stall in the pump. The mechanism may comprise one or more motion sensors configured to sense ends of a stroke of the piston. The mechanism may comprise a motor overcurrent detection circuit configured to measure a current drawn by the motor and to deactivate the motor when the current is greater than a pre-determined level. The mechanism may comprise a clutch disposed between the output shaft of the motor and the piston, the clutch being configured to disengage when a torque between the output shaft and the piston exceeds a mechanically-set threshold.

According to another aspect, a diaphragm pump may comprise a housing defining a first working chamber and a second working chamber, a first flexible diaphragm separating the first working chamber into a first pump chamber and a first motive fluid chamber, a second flexible diaphragm separating the second working chamber into a second pump chamber and a second motive fluid chamber, a channel in fluid communication with the first and second motive fluid chambers, a rod mechanically linking the first and second flexible diaphragms, a piston disposed within the channel and configured to reciprocate to cause a hydraulic fluid contained within the channel and the first and second motive fluid chambers to alternately exert an expansion force on the first and second flexible diaphragms, a motor operatively connected to the piston and configured to drive reciprocal movement of the piston, and a clutch operatively connected between an output shaft of the motor and the piston, the clutch being configured to deactivate the motor upon detection of an overload condition.

In some embodiments, the rod may be configured to simultaneously contract one of the first and second flexible diaphragms as the other of the first and second flexible diaphragms expands. The motor may further comprise an arm having a first end attached to the output shaft and a roller bearing attached to a second end of the arm opposite the first end. The piston may comprise a cavity receiving the roller bearing, such that rotation of the output shaft causes movement of the roller bearing within the cavity, thereby causing reciprocal movement of the piston. The clutch may be configured to be engaged when a torque between the output shaft and the piston is below a mechanically-set threshold and to be disengaged when the torque between the output shaft and the piston exceeds the mechanically-set threshold.

According to yet another aspect, a method of operating a diaphragm pump comprising a housing defining first and second pumping chambers and a hydraulic fluid chamber, a first flexible diaphragm separating the first pumping chamber from the hydraulic fluid chamber, a second flexible diaphragm separating the second pumping chamber from the hydraulic fluid chamber, a rod mechanically linking the first and second diaphragms, a piston disposed within the hydraulic fluid chamber, and a motor operatively connected to the piston is disclosed. The method may comprise activating the motor to drive reciprocal movement of the piston, the reciprocal movement of the piston causing alternating expansion of the first and second flexible diaphragms, the rod causing alternating contraction of the first and second flexible diaphragms, and deactivating the motor upon detection of a stall condition within the pump.

In some embodiments, deactivating the motor may comprise disengaging a clutch operatively connected between an output shaft of the motor and the piston when a torque between the output shaft and the piston exceeds a mechanically-set threshold. Deactivating the motor may comprise measuring a current drawn by the motor and deactivating the motor if the measured current is greater than a pre-determined level. Deactivating the motor may comprise sensing motion of the piston near an end of a stroke of the piston and deactivating the motor if motion of the piston has not been detected for a pre-determined period of time.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
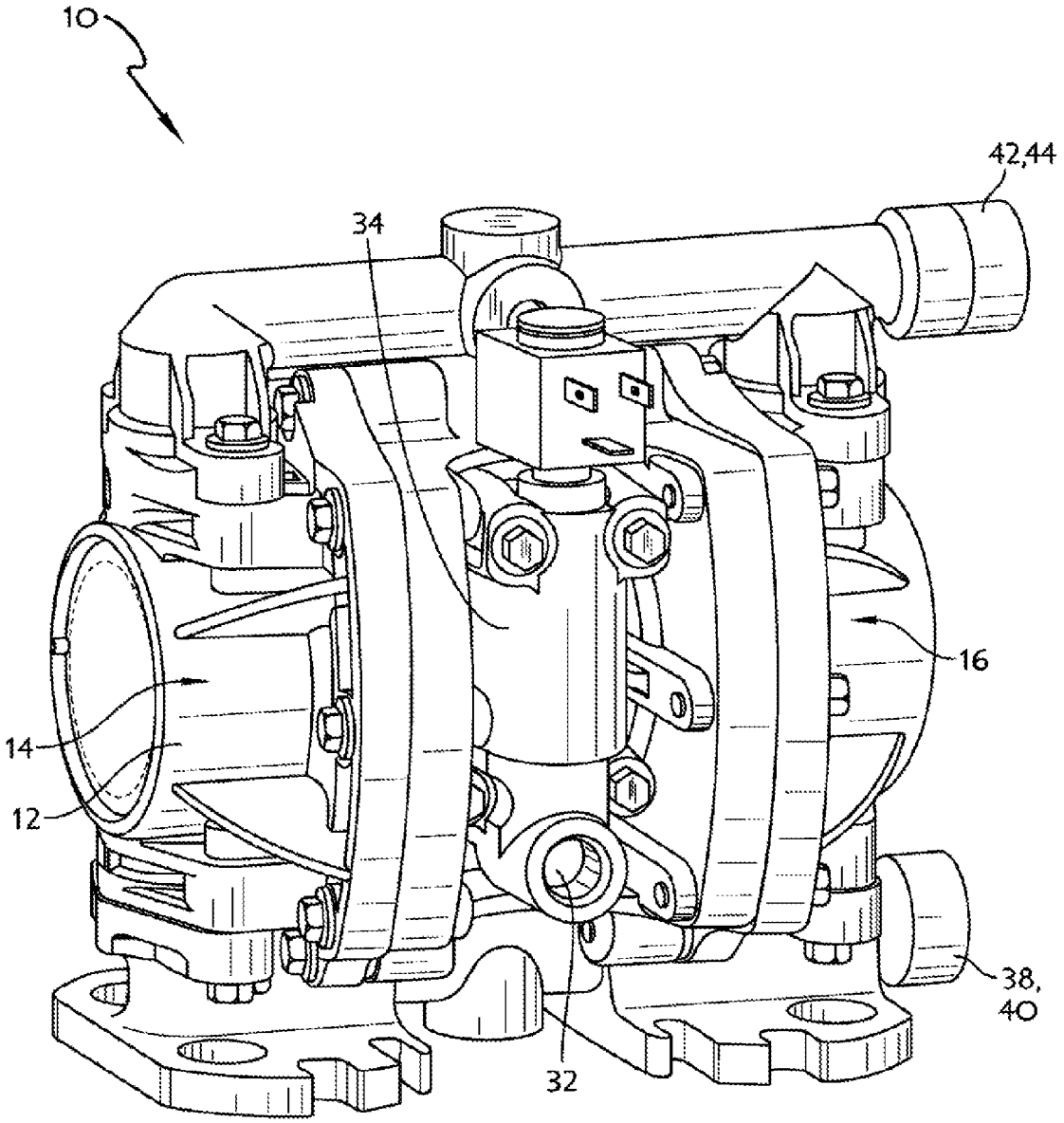
FIG. 1 is a front perspective view of at least one embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, a diaphragm pump 10 is shown. The pump 10 of FIG. 1 is illustratively embodied in FIG. 2 as a pneumatically actuated double-diaphragm pump. It is contemplated that, in other embodiments, the pump 10 may be embodied as any other type of diaphragm pump. In the illustrative embodiment, the pump 10 has a housing 12 that defines a first working or pumping chamber 14 and a second working or pumping chamber 16.

Figure 2:
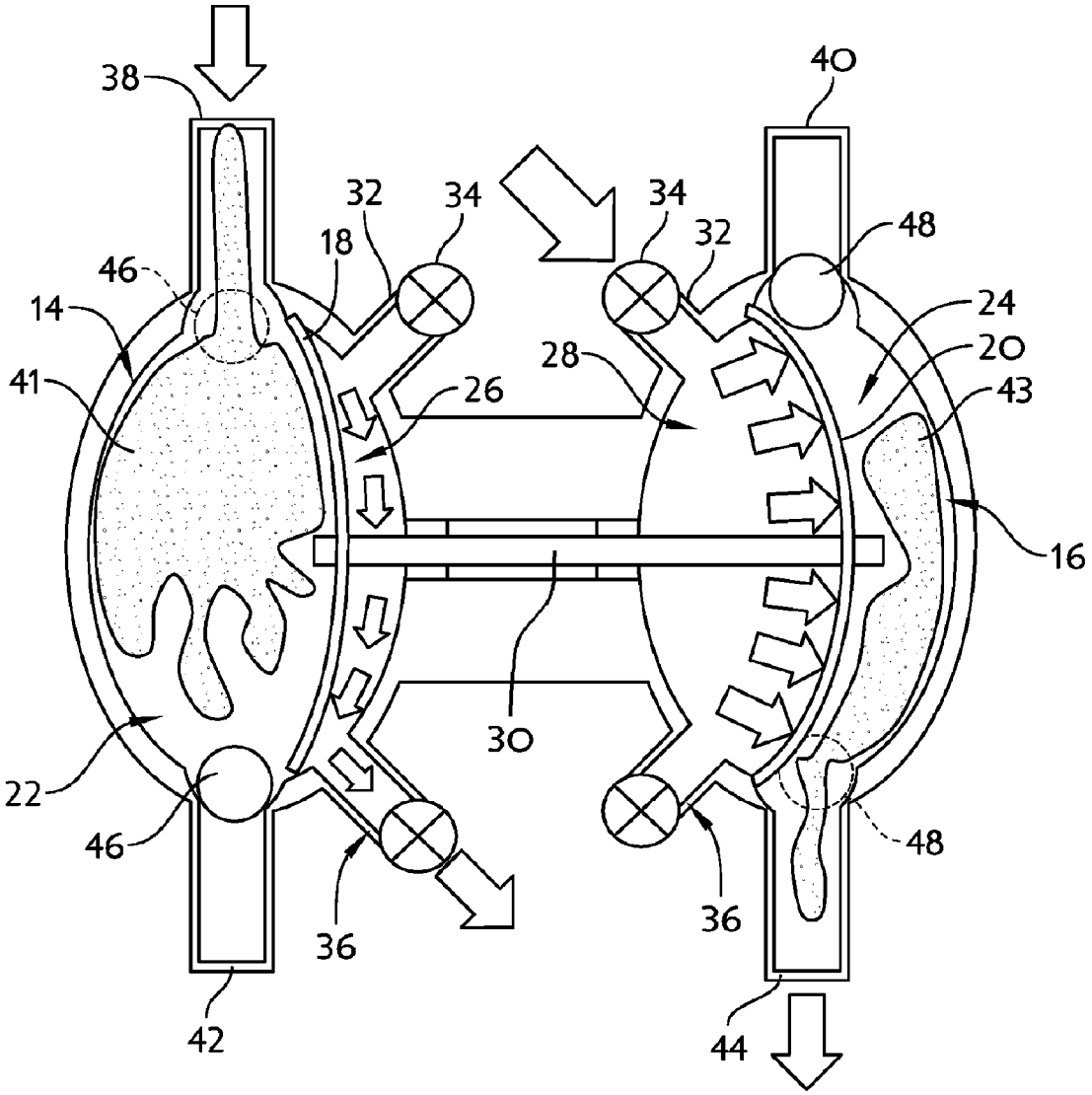
FIG. 2 (Prior Art)
FIG. 2 is a schematic cross-sectional view of a prior art pump that may be embodied within the pump housing of FIG. 1.

In an illustrative prior art embodiment, as seen in FIG. 2, the housing 12 is comprised of three sections coupled together by fasteners. The first and second working chambers 14, 16 of the pump 10 are each divided by respective first and second flexible diaphragms 18, 20 into respective first and second pump chambers 22, 24 and first and second motive fluid chambers 26, 28. The diaphragms 18, 20 are interconnected by a rod or shaft 30, such that when the diaphragm 18 is moved to increase the volume of the associated pump chamber 22, the other diaphragm 20 is simultaneously moved to decrease the volume of the associated pump chamber 24, and vice versa.

The shaft 30 illustrated in FIG. 2 is a reciprocating diaphragm link rod having a fixed length, such that the position of the shaft 30 in the pump 10 is indicative of the position of the diaphragms 18, 20. The shaft 30 and diaphragms 18, 20 move back and forth a fixed distance that defines a stroke. The fixed distance is determined by the geometry of the pump 10, the shaft 30, the diaphragms 18, 20, and other components of the pump 10 (e.g., the diaphragm washers). A stroke is defined as the travel path of the shaft 30 between first and second end-of-stroke positions. Movement of the shaft 30 from one end-of-stroke position to the other end-of-stroke position and back defines a cycle of operation of the shaft 30 (i.e., a cycle includes two consecutive strokes).

The pump 10 includes one or more inlets 32 for the supply of a motive fluid (e.g., compressed air, or another pressurized gas) to the first and second motive fluid chambers 26, 28 to drive reciprocation of the diaphragms 18, 20 and the shaft 30. The pump 10 may be alternately connected to the inlets 32. Alternatively, one or more valves 34 may be connected to one or more inlets for alternately supplying the motive fluid to the first and second motive fluid chambers 26, 28. When the valve 34 supplies motive fluid to the motive fluid chamber 26, the valve 34 places an exhaust assembly 36 in communication with the other motive fluid chamber 28 to permit motive fluid to be expelled therefrom. Conversely, when the valve 34 supplies motive fluid to the motive fluid chamber 28, the valve 34 places the motive fluid chamber 26 in communication with the exhaust assembly 36. In the illustrative embodiment of the pump 10, movement of the valve 34 between these positions is controlled by a solenoid valve. As such, by controlling movement of the valve 34, the solenoid valve of the pump 10 controls the supply of the motive fluid to the first and second motive fluid chambers 26, 28.

During operation of the pump 10, as the shaft 30 and the diaphragms 18, 20 reciprocate, the first and second pump chambers 22, 24 alternately expand and contract to create respective low and high pressure within the respective first and second pump chambers 22, 24. The pump chambers 22, 24 each communicate with an inlet manifold 38, 40 that may be connected to a source of fluid 41, 43, respectively, to be pumped and also each communicate with an outlet manifold, or fluid outlet, 42, 44 that may be connected to a receptacle for the fluid 41, 43 being pumped. Check valves 46, 48 ensure that the fluid 41, 43 being pumped moves only from the inlet manifold 38, 40 toward the outlet manifold 42, 44 when an appropriate amount of vacuum pressure is stored within the respective motive fluid chamber 26, 28. Referring to FIG. 2, the check valves 46, 48 are shown in an upper position when fluid 41, 43 within the pump chambers 22, 24 is to be pumped from the respective chamber and in a lower position when fluid 41, 43 within the pump chambers is to remain within the respective chamber. When the pump chamber 22 expands, the resulting negative pressure draws fluid 41 from the inlet manifold 38 into the pump chamber 22. Simultaneously, the other pump chamber 24 contracts, which creates positive pressure to force fluid 43 contained therein into the outlet manifold 44. Subsequently, as the shaft 30 and the diaphragms 18, 20 move in the opposite direction, the pump chamber 22 will contract and the pump chamber 24 will expand (forcing fluid 41 contained in the pump chamber 22 into the outlet manifold 42 and drawing fluid 43 from the inlet manifold 40 into the pump chamber 24).

Figure 3:
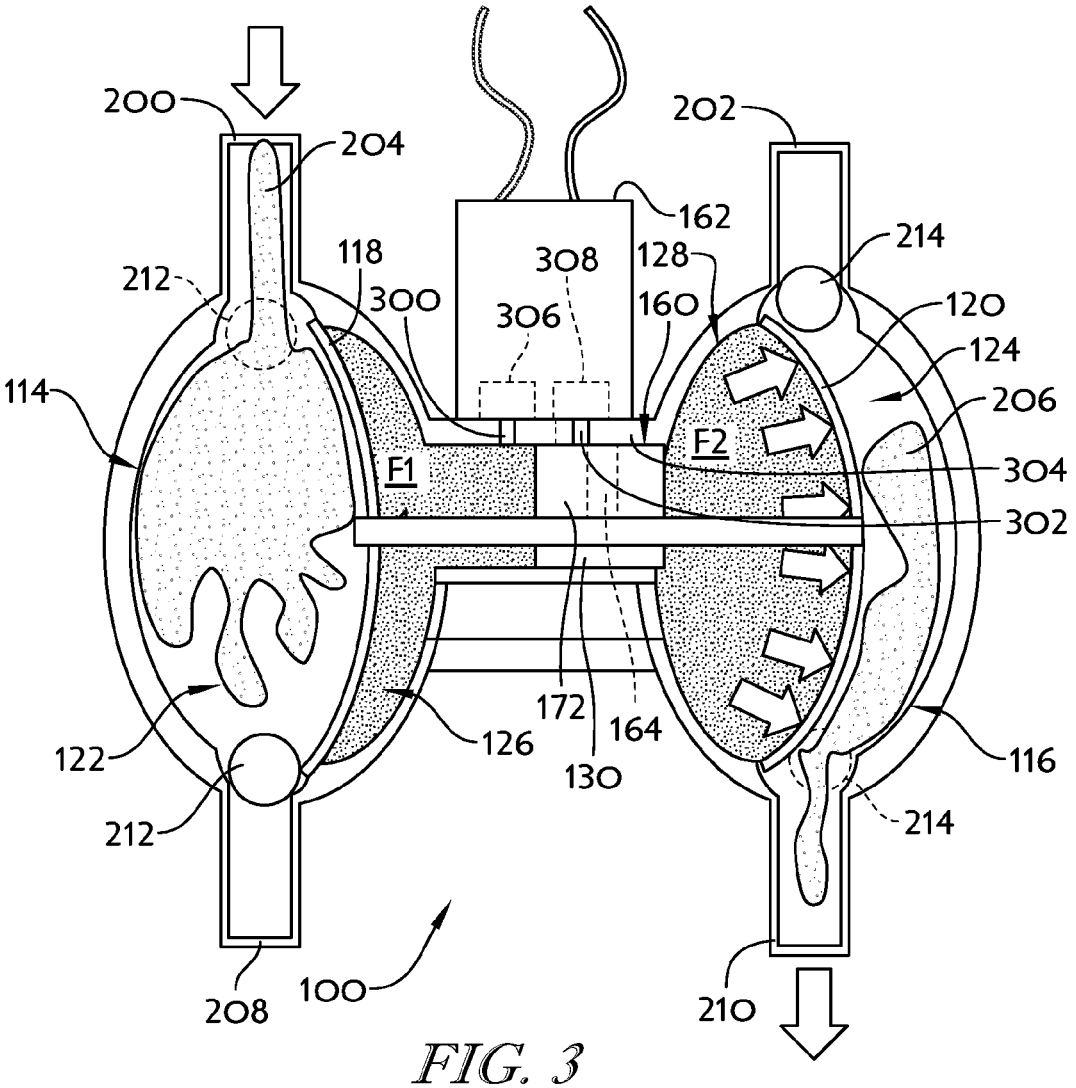
FIG. 3 is a schematic cross-sectional view of an embodiment of a hydraulically actuated pump that may be embodied within the pump housing of FIG. 1.

Referring now to FIG. 3, an illustrative embodiment of a hydraulically actuated pump 100 is depicted. In the illustrative embodiment, the pump 100 has a housing, for example, similar to the housing 12 seen in FIG. 1. The housing of the pump 100 defines a first working or pumping chamber 114 and a second working or pumping chamber 116. The first and second working chambers 114, 116 of the pump 100 are each divided by respective first and second flexible diaphragms 118, 120 into respective first and second pump chambers 122, 124 and first and second motive fluid chambers 126, 128. The diaphragms 118, 120 are interconnected by a rod or shaft 130, such that when the diaphragm 118 is moved to increase the volume of the associated pump chamber 122, the other diaphragm 120 is simultaneously moved to decrease the volume of the associated pump chamber 124, and vice versa.

The shaft 130 illustrated in FIG. 3 is a reciprocating diaphragm link rod having a fixed length, such that the position of the shaft 30 in the pump 10 is indicative of the position of the diaphragms 118, 120. The shaft 130 may be attached to the diaphragms 118, 120 by plastic washers or in any other suitable manner. The shaft 130 and diaphragms 118, 120 move back and forth a fixed distance that defines a stroke. The fixed distance is determined by the geometry of the pump 100, the shaft 130, the diaphragms 118, 120, and other components of the pump 100 (e.g., the diaphragm washers). A stroke is defined as the travel path of the shaft 130 between first and second end-of-stroke positions. Movement of the shaft 130 from one end-of-stroke position to the other end-of-stroke position and back defines a cycle of operation of the shaft 130 (i.e., a cycle includes two consecutive strokes).

Figure 4:
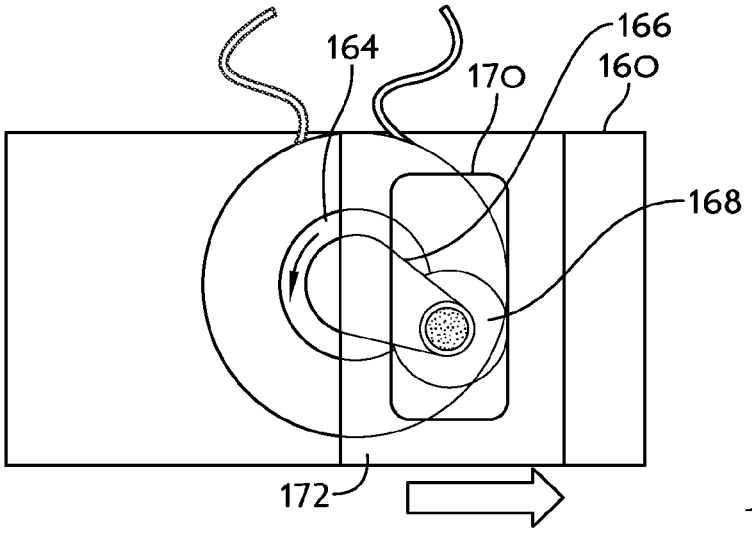
FIG. 4 is a schematic view of an exemplary hydraulic drive mechanism in the form of a motor-piston drive mechanism that may be used with the pump of FIG. 3.

Referring to FIG. 3, the shaft 130 extends through the first and second motive fluid chambers 126, 128 and through a channel 160, for example a cylindrical channel, extending between and in fluid communication with the motive fluid chambers 126, 128. An electric motor 162, for example an alternating current or direct current motor, is operatively connected to the shaft 130 to move the shaft 130 back and forth (i.e., left and right, as seen in FIG. 3). As seen in FIG. 4, the electric motor 162 may include an output shaft 164 that may be rotated, for example, in a counterclockwise direction. An arm 166 extends outwardly from the output shaft 164 and includes a roller bearing 168 on an end thereof. The roller bearing 168 is accepted and rides within a cavity 170 of a piston 172, wherein the cavity 170 has a longitudinal extent that may be generally perpendicular to movement of the piston 172.

Prior to operation of the pump 100, an amount of motive fluid F1 in the motive fluid chamber 126 and a portion of the channel 160 in fluid communication with the motive fluid chamber 126 may be generally the same as an amount of motive fluid F2 in the motive fluid chamber 128 and a portion of the channel 160 in fluid communication with the motive fluid chamber 128.

As the electric motor 162 rotates an output shaft 164, the arm 166 and the roller bearing 168 rotate with the output shaft 164. The roller bearing 168 moves back and forth along the cavity 170 of a piston 172 to accommodate the rotation of the arm 166. When the roller bearing 168 reaches a first edge 180 of the cavity 170, and the arm 166 continues to rotate, the piston 172 is moved along the channel 160 toward the chamber 114. Likewise, as the roller bearing 168 reaches a second edge 182 of the cavity 170, and the arm 166 continues to rotate, the piston 172 is moved along the channel 160 toward the chamber 116. The piston 172 may be positioned within the channel 160 such that the motive fluids F1, F2 may be prevented from passing the piston 172. In an illustrative embodiment, a seal may be formed around one or more portions of the piston 172 to prevent movement of motive fluid F1, F2 past the piston 172, while still allowing movement of the piston 172. As the piston moves, the overall space in which the motive fluids F1, F2 are held increases and decreases, thereby causing alternating low and high pressure against the flexible diaphragms 118, 120, which, in turn, causes the flexible diaphragms 118, 120 to contract and expand.

As seen in FIG. 3, each of the pump chambers 122, 124 communicates with an inlet manifold 200, 202 that may be connected to a source of fluid 204, 206 to be pumped. Each of the pump chambers 122, 124 also communicates with an outlet manifold, or fluid outlet 208, 210. Check valves 212, 214 ensure that the fluid 204, 206 being pumped moves only from the inlet manifold 200, 202 toward the outlet manifold 208, 210 when an appropriate amount of vacuum pressure is stored within the respective motive fluid chamber 126, 128. Referring to FIG. 3, the check valves 212, 214 are shown in an upper position when fluid 204, 206 within the pump chambers 122, 124 is to be pumped from the respective chamber and in a lower position when fluid 204, 206 within the pump chambers 122, 124 is to remain within the respective chamber. When the pump chamber 122 expands, the resulting negative pressure draws fluid 204 from the inlet manifold 200 into the pump chamber 122. Simultaneously, the other pump chamber 124 contracts, which creates positive pressure to force fluid 206 contained therein into the outlet manifold 210. Subsequently, as the shaft 130 and the diaphragms 118, 120 move in the opposite direction, the pump chamber 122 will contract and the pump chamber 124 will expand (forcing fluid 204 contained in the pump chamber 122 into the outlet manifold 208 and drawing fluid 206 from the respective inlet manifold 202 into the pump chamber 124).

A mechanism for overload or stall protection may be implemented within the pump 100 of FIG. 3 to protect the electric motor 162 from a potentially damaging condition wherein a main hydraulic pump output is blocked or does not permit free operation. In an illustrative embodiment, for example should the piston 172 get stuck and stop reciprocating, the motor 162 would generally continue providing rotational energy to the output shaft 164, thereby creating the potential for damage to the motor 162. The methods of stall protection disclosed herein may halt operation of the motor 162 in the presence of potentially damaging conditions.

Figure 5:
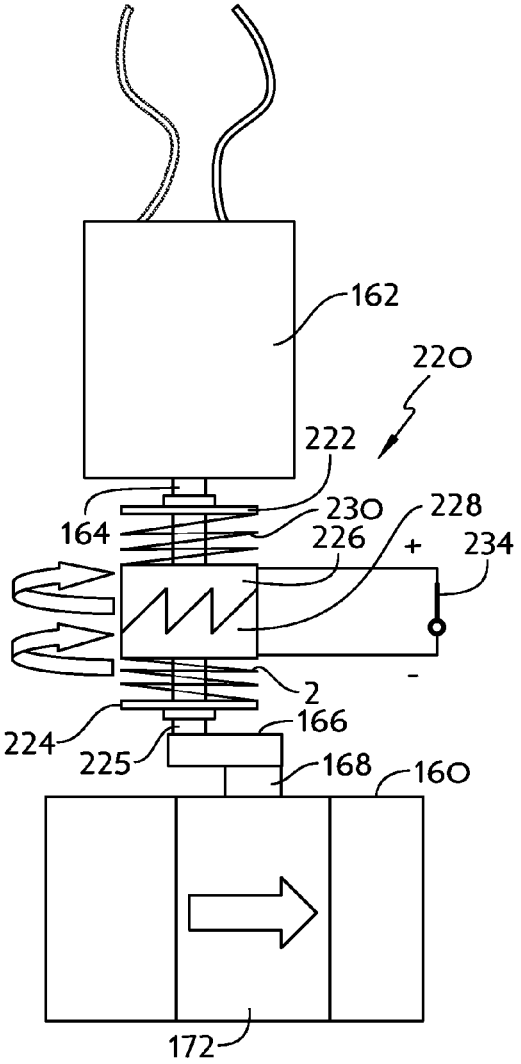
FIG. 5 is an elevational view of an exemplary hydraulic drive mechanism that may be used with the pump of FIG. 3, wherein an overload clutch is depicted in an engaged condition.
Figure 6:
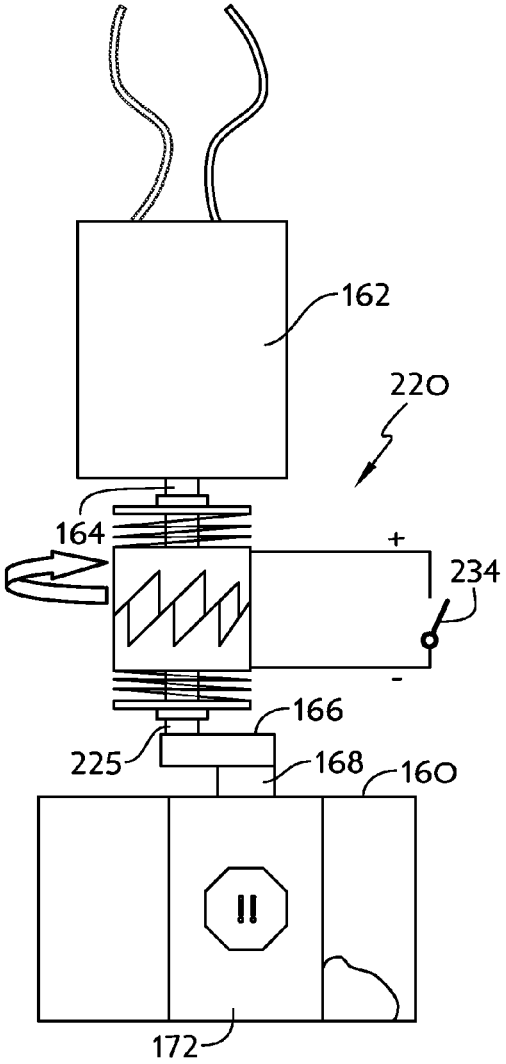
FIG. 6 is an elevational view of the hydraulic drive mechanism of FIG. 5 with the overload clutch depicted in a disengaged or separated condition.

In an illustrative embodiment of stall protection, as seen in FIGS. 5 and 6, an overload clutch 220 may be positioned between the output shaft 164 of the electric motor 162 and the piston 172. The overload clutch 220 may generally include first and second discs 222, 224 attached to the rotatable output shaft 164 of the motor 162 and a shaft 225 extending between the second disc 224 and the arm 166, respectively. First and second clutch gears 226, 228 are attached to the output shaft 164 and the shaft 225, respectively, and are biased into engagement by springs 230, 232 disposed between the clutch gears 226, 228 and the discs 222, 224. When the clutch gears 226, 228 are engaged, as described in detail above, the output shaft 164 rotates the gears 226, 228, as seen in FIG. 5, which transfer rotational energy to the shaft 225, the arm 166 and the roller bearing 168, which causes reciprocating movement of the piston 172. If the piston 172 is not moving freely (or other issues are present with the pump 100 and/or piston 172), the second clutch gear 228 remains stationary, as seen in FIG. 6. When a torque between the output shaft 164 of the motor 162 and the piston 172 is below a mechanically-set threshold of the overload clutch 220, no relative movement between the clutch gears 226, 228 occurs. If the torque between the output shaft 164 and the piston 172 exceeds the mechanically-set threshold of the overload clutch 220, relative movement between the clutch gears 226, 228 occurs, thereby causing the clutch gears 226, 228 to separate. Separation of the clutch gears 226, 228 may be used to trigger a switch 234 to deactivate the motor 162 and/or other components of the pump 100. Alternatively, separation of the clutch gears 226, 228 may trigger any other suitable event, condition, or alarm.

Figure 7:
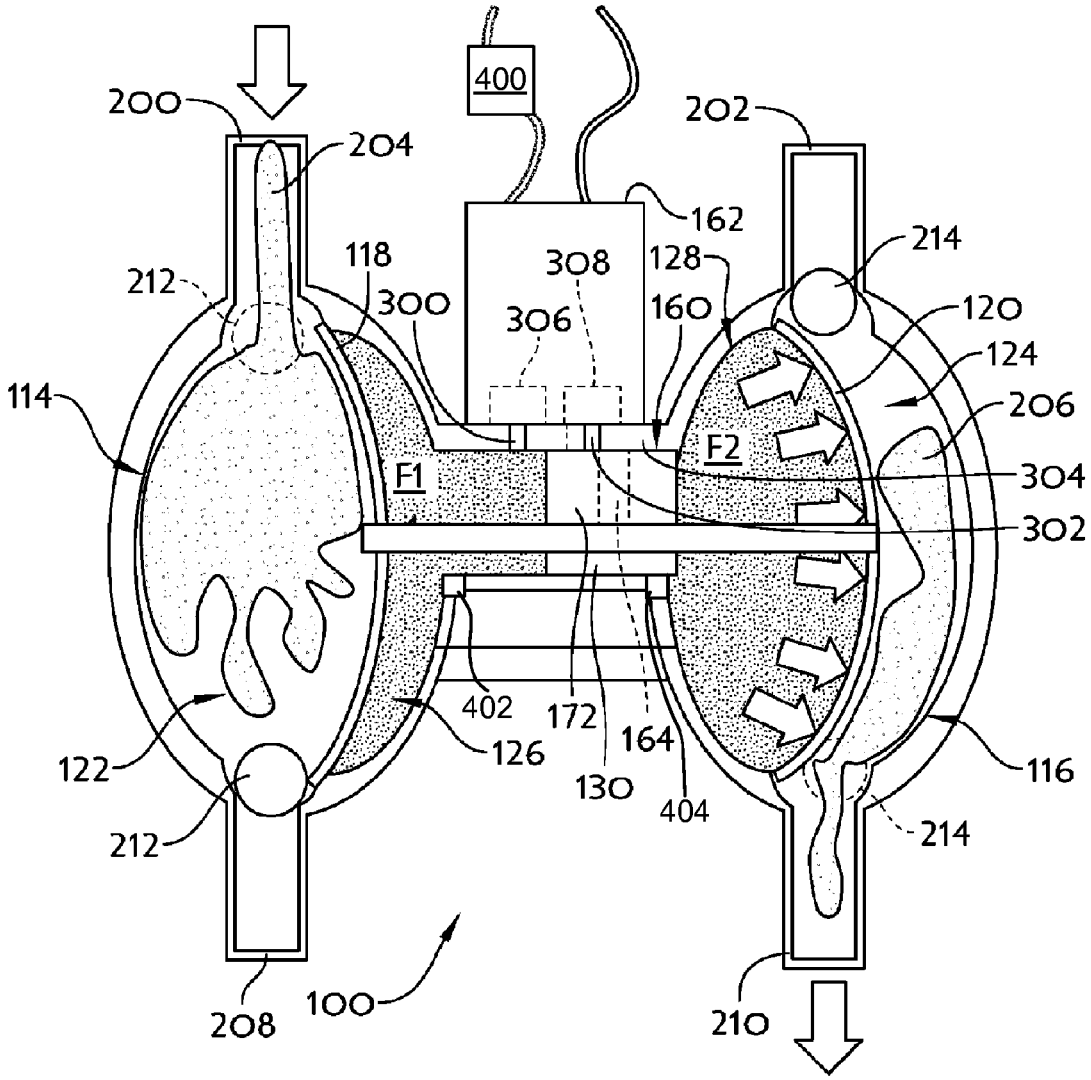
FIG. 7 is a schematic cross-sectional view of an additional embodiment of a hydraulically actuated pump that may be embodied within the pump housing of FIG. 1.

In a further illustrative embodiment, as shown in FIG. 7, the stall protection may be implanted within circuitry as a motor overcurrent detection circuit 400 that may deactivate the motor 162 when a measured current drawn by the electric motor 162 is greater than a pre-determined safe level.

In a still further illustrative embodiment of stall protection, a position of the piston 172 may be monitored by motion sensors 402, 404 (e.g., Hall effect sensors) mounted at or near an end of each piston stroke. If no signal is received from a sensor within a particular time interval (e.g., due to a blockage in the system, breakage of the connection between the motor 162 and the piston 172, etc.), the motor 162 may be deactivated.

In illustrative embodiments, the pump 100 may include one or more mechanisms for compensating for leakage within the pump 100, for example, from the motive fluid chambers 126, 128. At times, motive fluid F1 or F2 may escape from the pump 100, which can create issues with operation of the pump 100. It is therefore desirable to replace lost motive fluid F1, F2. Referring to FIG. 3, an illustrative embodiment of a leakage compensation mechanism is depicted as having two ports 300, 302 within an upper wall 304 of the channel 160. Each port 300, 302 may be in fluid communication with a respective motive fluid reservoir 306, 308 containing motive fluid. The motive fluid reservoirs 306, 308 may be positioned adjacent the upper wall 304 of the channel 160 and may be of any size and/or shape. As the piston 172 moves back and forth along the channel 160, the piston 172 may alternatingly block and unblock the ports 300, 302. More specifically, as the piston 172 reaches the end of a stroke, for example in its right-most position in which no pressure is exerted on the motive fluid F1, as seen in FIG. 3, the piston 172 would no longer block the port 300 (and would block the port 302). Similarly, as the piston 172 reaches its left-most position in which no pressure is exerted on the motive fluid F2, the piston 172 would no longer block the port 302 (and would block the port 300). In this manner, the ports 300, 302 would only be unblocked at the end of a stroke. When the ports 300, 302 are unblocked, if bubbles or open space are present within the respective motive fluid chamber 126, 128, the motive fluid within the respective motive fluid reservoir would be pumped into the respective motive fluid chamber 126, 128 to replace the empty space or bubbles (until the respective motive fluid chamber 126, 128 is full).

While a single portion 300, 302 is shown in conjunction with each motive fluid chamber 126, 128, multiple fluid ports may alternatively be used. Still further, while two motive fluid reservoirs 306, 308 are depicted, a single reservoir may alternatively communicate with both (or all, if more than two total) ports 300, 302. In any of the embodiments described herein, the rod 130 may be positioned toward the inlet manifolds 200, 202 or toward the outlet manifolds 208, 210. In alternative embodiments, any other suitable mechanism or method for compensating for leakage may be additionally or alternatively used within the pump 100.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A diaphragm pump comprising:

a housing defining a first pumping chamber, a second pumping chamber, a first hydraulic fluid chamber, and a second hydraulic fluid chamber;

a first flexible diaphragm separating the first pumping chamber from the first hydraulic fluid chamber;

a second flexible diaphragm separating the second pumping chamber from the second hydraulic fluid chamber;

a rod mechanically linking the first flexible diaphragm and the second flexible diaphragm such that an expansion of one of the first and second flexible diaphragms exerts a contraction force on the other of the first and second flexible diaphragms;

a piston disposed in a channel located between, and fluidly connected to, the first hydraulic fluid chamber and the second hydraulic fluid chamber, separating the first and second hydraulic fluid chambers, and configured to reciprocate to cause a hydraulic fluid contained within the hydraulic fluid chamber and the second hydraulic fluid chamber to alternately exert an expansion force on the first and second flexible diaphragms, wherein a first port and a second port are spaced apart from each other, and each are disposed through a wall of the channel such that when the piston is located at a first end of stroke position the first port is unblocked by the piston and the second port is blocked by the piston to allow fluid communication into the channel from the first port wherein additional hydraulic fluid enters the channel through the first port if an air space is located in either the first hydraulic fluid chamber or the channel, and when the piston is located at a second end of stroke position the second port is unblocked by the piston and the first port is blocked by the single piston to allow fluid communication into the channel from the second port wherein additional hydraulic fluid enters the channel through the second port if an air space is located in either the second hydraulic fluid chamber or the channel; and a rotational motor operatively connected to the piston to cause the reciprocal movement of the piston, wherein the rotational motor comprises a rotatable output shaft, an arm having a first end attached to the output shaft, and a roller bearing attached to a second end of the arm opposite the first end, wherein the roller bearing is received in the cavity of the piston such that rotation of the output shaft causes reciprocal movement of the roller bearing within the cavity along the longitudinal extent perpendicular to the reciprocal movement of the piston, thereby causing the reciprocal movement of the piston.

2. The diaphragm pump of claim 1, wherein the first port and the second port are in fluid communication with a hydraulic fluid reservoir.

3. The diaphragm pump of claim 1, further comprising a mechanism configured to deactivate the rotational motor upon detection of a stall in the pump.

4. The diaphragm pump of claim 3, wherein the mechanism comprises a clutch disposed between the output shaft of the rotational motor and the piston, the clutch being configured to disengage when a torque between the output shaft and the piston exceeds a mechanically-set threshold.

5. The diaphragm pump of claim 3, wherein the mechanism comprises a motor overcurrent detection circuit configured to measure a current drawn by the rotational motor and to deactivate the rotational motor when the current is greater than a pre-determined level.

6. The diaphragm pump of claim 3, wherein the mechanism comprises one or more motion sensors configured to sense end of the stroke of the piston.

7. A diaphragm pump comprising:

a housing defining a first working chamber and a second working chamber;

a first flexible diaphragm separating the first working chamber into a first pump chamber and a first motive fluid chamber;

a second flexible diaphragm separating the second working chamber into a second pump chamber and a second motive fluid chamber;

a channel in fluid communication with the first and second motive fluid chambers;

a rod mechanically linking the first and second flexible diaphragms;

a piston disposed within the channel and configured to reciprocate to cause a hydraulic fluid contained within the channel and the first and second motive fluid chambers to alternately exert an expansion force on the first and second flexible diaphragms;

wherein a first port and a second port are spaced apart from each other, and each are disposed through a wall of the channel such that when the piston is located at a first end of stroke position the first port is unblocked by the piston and the second port is blocked by the piston to allow fluid communication into the channel from the first port wherein additional hydraulic fluid enters the channel through the first port if an air space is located in either the first hydraulic fluid chamber or the channel, and when the piston is located at a second end of stroke position the second port is unblocked by the piston and the first port is blocked by the single piston to allow fluid communication into the channel from the second port wherein additional hydraulic fluid enters the channel through the second port if an air space is located in either the second hydraulic fluid chamber or the channel;

a motor operatively connected to the piston and configured to drive reciprocal movement of the piston; and a clutch operatively connected between an output shaft of the motor and the piston, the clutch being configured to deactivate the motor upon detection of an overload condition;

wherein the motor further comprises an arm having a fist end attached to the output shaft and roller bearing attached to a second end of the arm opposite the first end;

wherein the piston comprises a cavity receiving the roller bearing, such that rotation of the output shaft causes reciprocal movement of the roller bearing within the cavity along a longitudinal extent perpendicular to the reciprocal movement of the position, thereby causing the reciprocal movement of the piston.

8. The diaphragm pump of claim 7, wherein the rod is configured to simultaneously contract one of the first and second flexible diaphragms as the other of the first and second flexible diaphragms expands.

9. The diaphragm pump of claim 7, wherein the clutch is configured to be engaged when a torque between the output shaft and the piston is below a mechanically-set threshold and to be disengaged when the torque between the output shaft and the piston exceeds the mechanically-set threshold.

10. The diaphragm pump of claim 7, wherein:

the channel includes the first port in fluid communication with a hydraulic fluid reservoir and the second port in fluid communication with a hydraulic fluid reservoir; and the piston reciprocates between the first end of stroke position and the second end of stroke position, wherein in the first end of stroke position the piston blocks the first port and unblocks the second port, and wherein in the second end of stroke position the piston unblocks the first port and blocks the second port.

11. The diaphragm pump of claim 10, wherein the first port and the second port are in fluid communication with the same hydraulic fluid reservoir.

12. A method of operating a diaphragm pump comprising a housing defining first and second pumping chambers and first and second hydraulic fluid chambers, a first flexible diaphragm separating the first pumping chamber from the first hydraulic fluid chamber, a second flexible diaphragm separating the second pumping chamber from the second hydraulic fluid chamber, a rod mechanically linking the first and second diaphragms, a piston disposed in a channel, located between and fluidly connected to, the first and second hydraulic fluid chambers and including a longitudinal extent perpendicular to reciprocal movement of the piston, wherein a first port and a second port are spaced apart from each other, and each are disposed through a wall of the channel such that when the piston is located at a first end of stroke position the first port is unblocked by the piston and the second port is blocked by the piston to allow fluid communication into the channel from the first port wherein additional hydraulic fluid enters the channel through the first port if an air space is located in either the first hydraulic fluid chamber or the channel, and when the piston is located at a second end of stroke position the second port is unblocked by the piston and the first port is blocked by the single piston to allow fluid communication into the channel from the second port wherein additional hydraulic fluid enters the channel through the second port if an air space is located in either the second hydraulic fluid chamber or the channel, and a rotational motor operatively connected to the piston, wherein the rotational motor includes a rotatable output shaft, an arm having a first end attached to the output shaft, and a roller bearing attached to a second end of the arm opposite the first end, wherein the roller bearing is received in a cavity of the piston such that rotation of the output shaft causes reciprocal movement of the roller bearing within the cavity along the longitudinal extent perpendicular to the reciprocal movement of the piston, the method comprising:

activating the rotational motor to drive the reciprocal movement of the piston, the reciprocal movement of the piston causing alternating expansion of the first and second flexible diaphragms, the rod causing alternating contraction of the first and second flexible diaphragms; and deactivating the rotational motor upon detection of a stall condition within the pump.

13. The method of claim 12, wherein the deactivating the rotational motor comprises:

measuring a current drawn by the rotational motor; and deactivating the rotational motor if the measured current is greater than a pre-determined level.

14. The method of claim 12, wherein the deactivating the rotational motor comprises:

sensing motion of the piston near an end of a stroke of the piston; and deactivating the rotational motor if motion of the piston has not been detected for a pre-determined period of time.

* * * * *